US010006294B2

(12) United States Patent
Itzel et al.

(10) Patent No.: US 10,006,294 B2
(45) Date of Patent: Jun. 26, 2018

(54) ARTICLE AND METHOD OF COOLING AN ARTICLE

(71) Applicant: GENERAL ELECTRIC COMPANY, Schenectady, NY (US)

(72) Inventors: Gary Michael Itzel, Simpsonville, SC (US); Srikanth Chandrudu Kottilingam, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 203 days.

(21) Appl. No.: 14/886,773

(22) Filed: Oct. 19, 2015

(65) Prior Publication Data

US 2017/0107831 A1 Apr. 20, 2017

(51) Int. Cl.
*F01D 5/18* (2006.01)

(52) U.S. Cl.
CPC ..... *F01D 5/187* (2013.01); *F01D 5/188* (2013.01); *F01D 5/189* (2013.01); *F01D 5/186* (2013.01); *F05D 2230/22* (2013.01); *F05D 2230/31* (2013.01); *F05D 2240/307* (2013.01); *F05D 2250/185* (2013.01); *F05D 2260/201* (2013.01); *F05D 2260/205* (2013.01)

(58) Field of Classification Search
CPC ..... F01D 5/186; F01D 5/187; F01D 5/188; F01D 5/189; F01D 9/065; F05D 2260/201; F05D 2260/202; F05D 2260/205; F05D 2240/307; F05D 2250/185
USPC .... 415/115; 416/90 R, 92, 96 R, 96 A, 97 R
See application file for complete search history.

(56) References Cited

U.S. PATENT DOCUMENTS

| | | | | |
|---|---|---|---|---|
| 3,051,439 | A * | 8/1962 | Hilton | B23H 9/10 416/97 R |
| 5,720,431 | A * | 2/1998 | Sellers | F01D 5/186 416/92 |
| 7,168,921 | B2 | 1/2007 | Honkomp et al. | |
| 7,568,882 | B2 | 8/2009 | Brittingham et al. | |
| 7,695,245 | B1 * | 4/2010 | Liang | F01D 5/189 416/1 |
| 2002/0119047 | A1 * | 8/2002 | Starkweather | F01D 5/187 416/97 R |
| 2005/0084370 | A1 * | 4/2005 | Gross | F01D 5/187 416/95 |
| 2007/0128034 | A1 * | 6/2007 | Lee | F01D 5/187 416/97 R |

(Continued)

*Primary Examiner* — Christopher Verdier
(74) *Attorney, Agent, or Firm* — McNees Wallace & Nurick LLC

(57) ABSTRACT

An article and method of cooling an article are provided. The article includes a body portion having an inner surface and an outer surface, the inner surface defining an inner region, at least one up-pass cavity formed within the inner region and extending from a base of the body portion towards a tip of the body portion, and a cap formed in each up-pass cavity, each cap being adjacent to the tip of the body portion, having at least one aperture formed therein, and being arranged and disposed to direct fluid towards the tip of the body potion. The method includes directing a fluid into the first up-pass cavity, passing the fluid through at least one aperture in the cap, contacting the tip of the article with the fluid, receiving the post-impingement fluid within a down-pass cavity, and directing the post-impingement fluid through the down-pass cavity.

18 Claims, 6 Drawing Sheets

(56) References Cited

U.S. PATENT DOCUMENTS

| | | | | |
|---|---|---|---|---|
| 2014/0178207 | A1* | 6/2014 | He | F01D 5/20<br>416/96 R |
| 2017/0167269 | A1 | 6/2017 | Itzel | |

* cited by examiner

ARTICLE AND METHOD OF COOLING AN ARTICLE

FIELD OF THE INVENTION

The present invention is directed to an article and a method of cooling an article. More particularly, the present invention is directed to a cooled article and a method of cooling an article.

BACKGROUND OF THE INVENTION

Turbine systems are continuously being modified to increase efficiency and decrease cost. One method for increasing the efficiency of a turbine system includes increasing the operating temperature of the turbine system. To increase the temperature, the turbine system must be constructed of materials which can withstand such temperatures during continued use.

In addition to modifying component materials and coatings, one common method of increasing temperature capability of a turbine component includes the use of cooling features. For example, many turbine components include impingement sleeves or impingement plates positioned within an internal cavity thereof. The impingement sleeves or plates include a plurality of cooling channels that direct a cooling fluid towards an inner surface of the turbine component, providing impingement cooling of the turbine component. However, forming separate individual impingement sleeves for positioning within the turbine components increases manufacturing time and cost. Additionally, impingement sleeves typically generate significant cross flow between the impingement sleeve and the turbine component, and require sufficient cooling fluid to provide fluid flow through each of the cooling channels at one time, both of which decrease efficiency of the system.

Another method of cooling turbine components includes the use of serpentine cooling. Serpentine cooling includes passing a cooling fluid through a passage within the turbine component to simultaneously cool both the pressure and suction side walls of the component. The simultaneous cooling of both walls may overcool one wall in order to sufficiently cool the other. The overcooling of one wall leads to thermal gradients as well as unnecessary heat pick-up, both of which decrease downstream cooling effectiveness and cooling efficiency.

BRIEF DESCRIPTION OF THE INVENTION

In an embodiment, an article includes a body portion having an inner surface and an outer surface, the inner surface defining an inner region, at least one up-pass cavity formed within the inner region, the at least one up-pass cavity extending from a base of the body portion towards a tip of the body portion, and a cap formed in each up-pass cavity, each cap being adjacent to the tip of the body portion and having at least one aperture formed therein. Each cap is arranged and disposed to direct fluid from the at least one up-pass cavity, through the at least one aperture formed therein, and towards the tip of the body potion.

In another embodiment, an article includes a body portion having an inner surface and an outer surface, the inner surface defining an inner region, at least one up-pass cavity formed within the inner region, the at least one up-pass cavity extending from a base of the body portion towards a tip of the body portion, at least one down-pass cavity fluidly connecting two up-pass cavities, each down-pass cavity being arranged and disposed to direct a fluid downstream from one of the two up-pass cavities to the other up-pass cavity or to be downstream from one of the two up-pass cavities, and a cap formed in each up-pass cavity, each cap being adjacent to the tip of the body portion and having at least one aperture formed therein. Each cap is arranged and disposed to direct fluid from the at least one up-pass cavity, through the at least one aperture formed therein, and towards the tip of the body potion, and each aperture in the cap is arranged and disposed to provide impingement cooling of the tip.

In another embodiment, a method of cooling an article includes directing a fluid into a first up-pass cavity formed within an inner region of the article, passing the fluid through at least one aperture in a cap formed in the first up-pass cavity, contacting a tip of the article with the fluid passing through the at least one aperture in the cap, the contacting of the tip with the fluid cooling the tip and forming a post-impingement fluid, receiving the post-impingement fluid within a down-pass cavity, directing the post-impingement fluid through the down-pass cavity and into a second up-pass cavity, passing the fluid from the second up-pass cavity through at least one aperture in an additional cap formed in the second up-pass cavity, and contacting the tip of the article with the fluid passing through the at least one aperture in the additional cap, the contacting of the tip with the fluid cooling the tip and forming a second post-impingement fluid.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided are an article and method of cooling an article. Embodiments of the present disclosure, for example, in comparison to concepts failing to include one or more of the features disclosed herein, increase cooling efficiency, increase tip cooling effectiveness, facilitate increased control of cooling flow distribution, increase downstream tip cooling, increase article life, facilitate use of increased system temperatures, increase system efficiency, provide increased control over film supply pressure, or a combination thereof.

Figure 1:
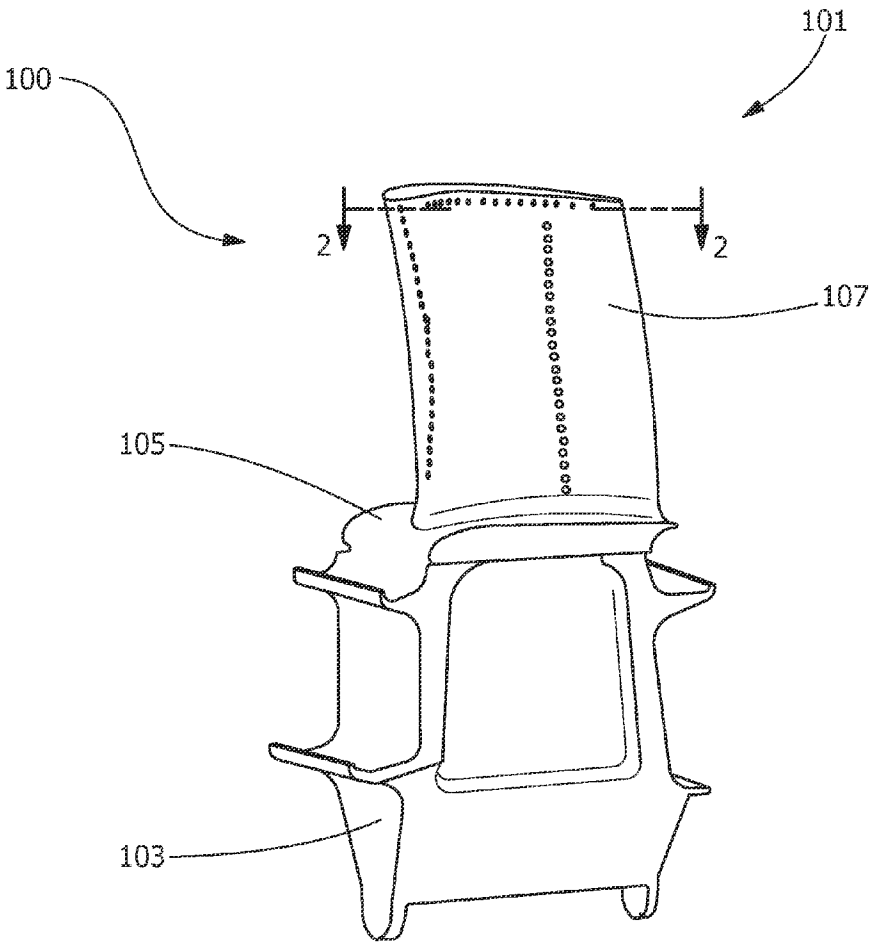
FIG. 1 is a front perspective view of an article, according to an embodiment of the disclosure.

Referring to FIG. 1, in one embodiment, an article 100 includes, but is not limited to, a turbine bucket 101 or blade. The turbine bucket 101 has a root portion 103, a platform 105, and an airfoil portion 107. The root portion 103 is configured to secure the turbine bucket 101 within a turbine system, such as, for example, to a rotor wheel. Additionally, the root portion 103 is configured to receive a fluid from the turbine system and direct the fluid into the airfoil portion 107. Although described herein with regard to a turbine bucket, as will be appreciated by those skilled in the art, the article 100 is not so limited and may include any other article suitable for receiving a cooling fluid, such as, for example, a hollow component, a hot gas path component, a shroud, a nozzle, a vane, or a combination thereof.

As illustrated in FIGS. 2-5, the article 100 includes a body portion 201 having an outer surface 203, an inner surface 205, and one or more partitions 210 formed therein. Each of the one or more partitions 210 extends across the inner region 207, from a first side of the article 100 to a second side of the article 100. For the purpose of more clearly illustrating the inner surface 205 and an inner region 207 defined by the inner surface 205, FIG. 6 shows the airfoil portion 107 of FIGS. 2-5 with the partitions 210 removed.

The one or more partitions 210 may be formed integral with and/or separate from the body portion 201. In one embodiment, forming the one or more partitions 210 integral with the body portion 201 decreases or eliminates passage of a fluid, such as a cooling fluid, between the one or more partitions 210 and the body portion 201, as compared to the one or more partitions 210 formed separate from and then secured to the body portion 201. In another embodiment, the forming of the one or more partitions 210 integral with the body portion 201 decreases or eliminates leakage to post impingement, as compared to the one or more partitions 210 formed separate from and then secured to the body portion 201. Suitable methods for forming the body portion 201 and/or the one or more partitions 210 include, but are not limited to, direct metal laser melting (DMLM), direct metal laser sintering (DMLS), selective laser melting (SLM), selective laser sintering (SLS), fused deposition modeling (FDM), any other additive manufacturing technique, or a combination thereof.

Figure 2:
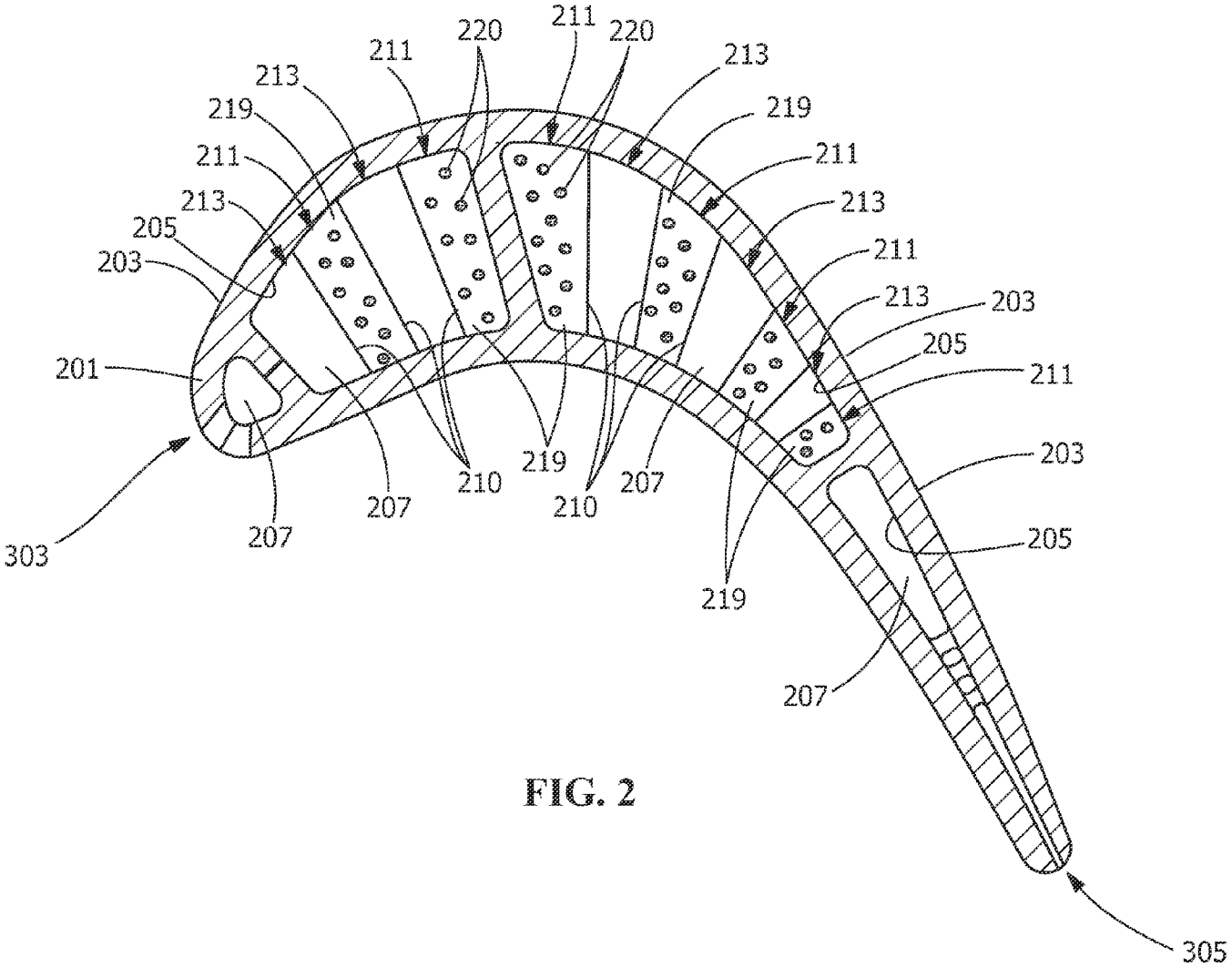
FIG. 2 is a section view of the article of FIG. 1, taken along the line 2-2, according to an embodiment of the disclosure.
Figure 3:
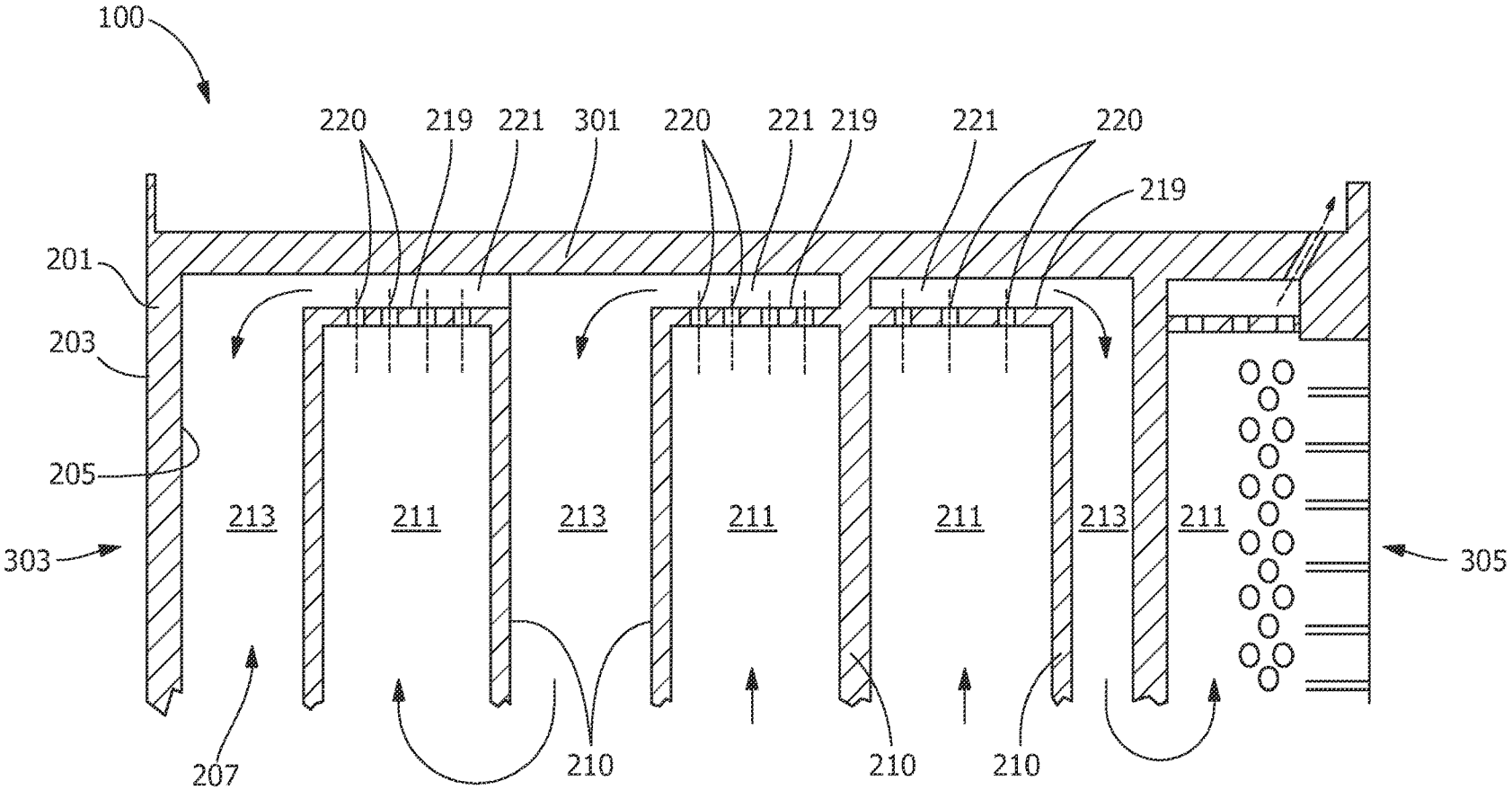
FIG. 3 is a section view of a cooling arrangement within an article, viewed orthogonal to the section view in FIG. 2.

Referring to FIGS. 2-3, in one embodiment, respective partitions 210 are positioned to form a serpentine cooling arrangement within the article 100. The serpentine cooling arrangement includes one or more up-pass cavities 211 and one or more down-pass cavities 213. Each of the respective up-pass cavities 211 is configured to direct a fluid towards a tip portion 301 (see FIG. 3) of the article 100, while each of the respective down-pass cavities 213 is configured to receive the fluid from one of the respective up-pass cavities 211 and direct the fluid away from the tip portion 301. Respective at least one down-pass cavity 213 is arranged and disposed to be downstream of respective at least one up-pass cavity 211. The article 100 includes any suitable number of up-pass cavities 211 and/or down-pass cavities 213, with the fluid passing sequentially through alternating up-pass cavities 211 and respective down-pass cavities 213 until it is released from the article 100. As the fluid passes along the inner surface 205 in the respective up-pass cavities 211 and the respective down-pass cavities 213 of the serpentine cooling arrangement, it provides cooling of the body portion 201. Additionally or alternatively, the fluid is vented through the body portion 201 and/or the tip portion 301, providing film cooling of the outer surface 203. In one embodiment, a first face of each respective partition 210 forms an inner wall of the respective at least one up-pass cavity 211 and a second face opposite the first face forms an inner wall of the respective at least one down-pass cavity 213.

Any suitable number of serpentine cooling arrangements may be formed in the article 100. Each serpentine cooling arrangement includes at least one up-pass cavity 211 configured to receive fluid entering the article 100, and provides a separate fluid flow through the article 100. In one embodiment, the article 100 includes a single serpentine cooling arrangement. The single serpentine cooling arrangement provides fluid flow in a single direction, such as from a leading edge 303 to a trailing edge 305 of the article 100, or vice-versa, with the fluid travelling sequentially through each of the up-pass cavities 211 and down-pass cavities 213 in the arrangement. In another embodiment, the article 100 includes two or more serpentine cooling arrangements. Each of the serpentine cooling arrangements includes one up-pass cavity 211 configured to receive the fluid entering the article 100, such as through the root portion 103, and provides sequential fluid flow in one direction. The direction of fluid flow in each serpentine cooling arrangement may be the same or different from the direction of fluid flow in the other serpentine cooling arrangement(s). For example, as illustrated in FIGS. 2-3, each of the serpentine cooling arrangements is configured to receive the fluid entering the article 100 and direct the fluid sequentially through the alternating up-pass cavities 211 and down-pass cavities 213, with one arrangement directing the fluid towards the leading edge 303 and the other arrangement directing the fluid towards the trailing edge 305.

As illustrated in FIGS. 2-3, at least one of the up-pass cavities 211 in the serpentine cooling arrangement includes a cap 219 formed therein. Each cap 219 extends across the up-pass cavity 211, and has at least one aperture 220 extending therethrough. In one embodiment, the cap 219 forms a closed end of the up-pass cavity 211 and/or creates a tip cavity 221 between the up-pass cavity 211 and the tip portion 301. In another embodiment, the at least one aperture 220 directs the fluid within the up-pass cavity 211 through the cap 219 and towards the tip portion 301. The fluid directed through the at least one aperture 220 contacts the tip portion 301, impinging thereon and providing impingement cooling thereof. After impinging upon the tip portion 301, a post-impingement fluid enters one of the down-pass cavities 213, which directs the fluid away from the tip portion 301. As used herein, "post-impingement fluid" refers to fluid directed towards a surface of the body portion 201 and/or the tip portion 301, and includes both the fluid that contacts, or impinges upon, the surface, as well as the fluid that is directed through the one or more apertures 220 but does not contact the surface.

Although shown as including one cap 219 formed within each of the up-pass cavities 211, as will be appreciated by those skilled in the art, the article 100 is not so limited and may include any combination of up-pass cavities 211 with and without the cap 219. Additionally, the geometry, orientation, and/or number of apertures 220 formed in each of the caps 219 may be the same, substantially the same, or different as compared to one or more other caps 219. Varying the geometry, orientation, and/or number of apertures 220 adjusts fluid pressure in the up-pass cavities 211, adjusts impingement cooling pressure, adjusts impingement fluid flow, or a combination thereof. For example, the cap 219 corresponding to a section of the tip portion 301 experiencing comparatively increased temperatures may include a greater number of apertures 220 than the cap 219 corresponding to a section of the tip portion 301 experiencing comparatively decreased temperatures, the greater number of apertures 220 providing increased cooling of the corresponding section of the tip portion 301. Additionally or alternatively, the number and/or size of the apertures 220 in the cap 219 may be selected to increase or decrease the fluid pressure in the corresponding up-pass cavity 211.

Figure 4:
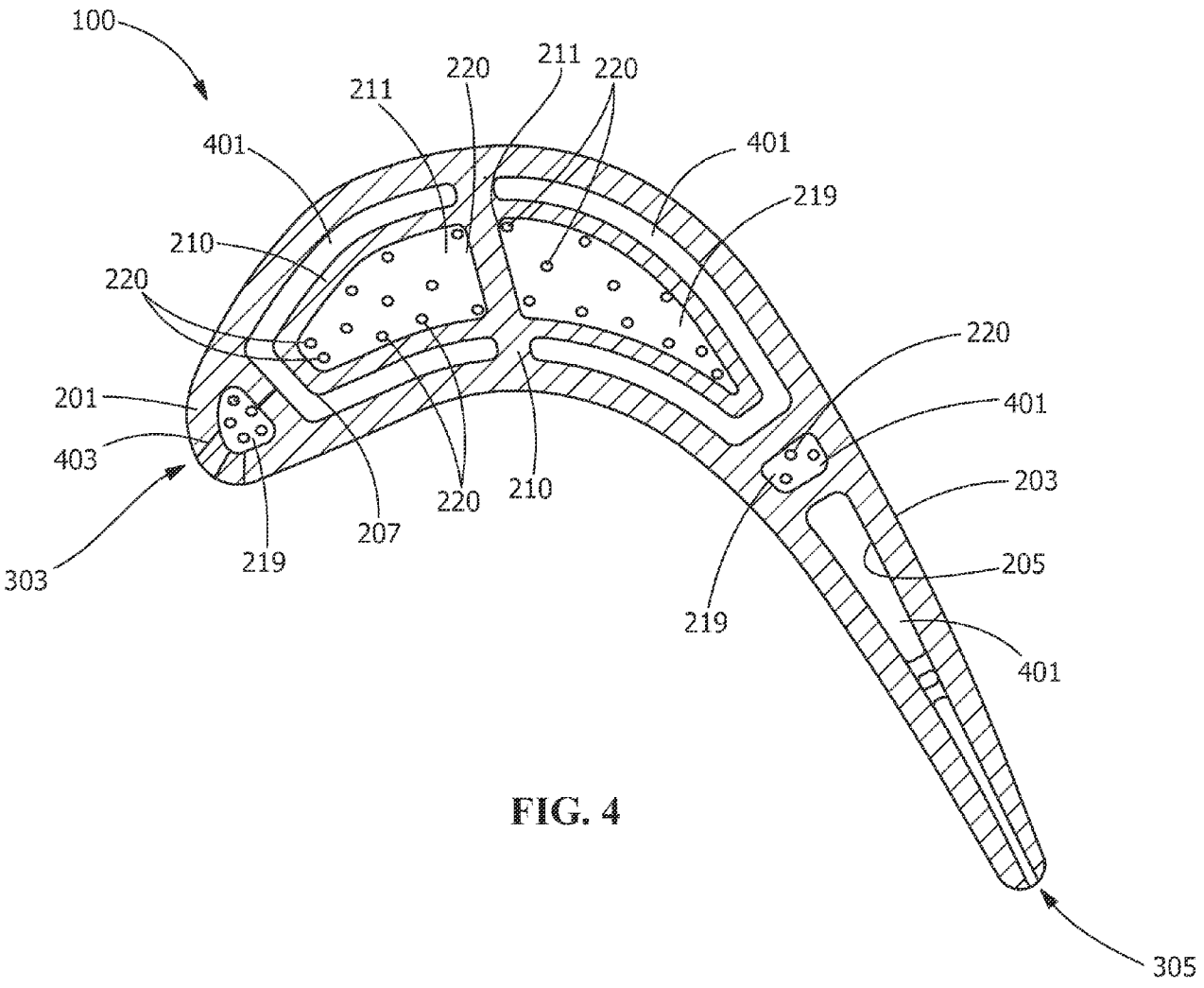
FIG. 4 is a section view of the article of FIG. 1, taken along the line 2-2, according to an alternate embodiment of the disclosure.
Figure 5:
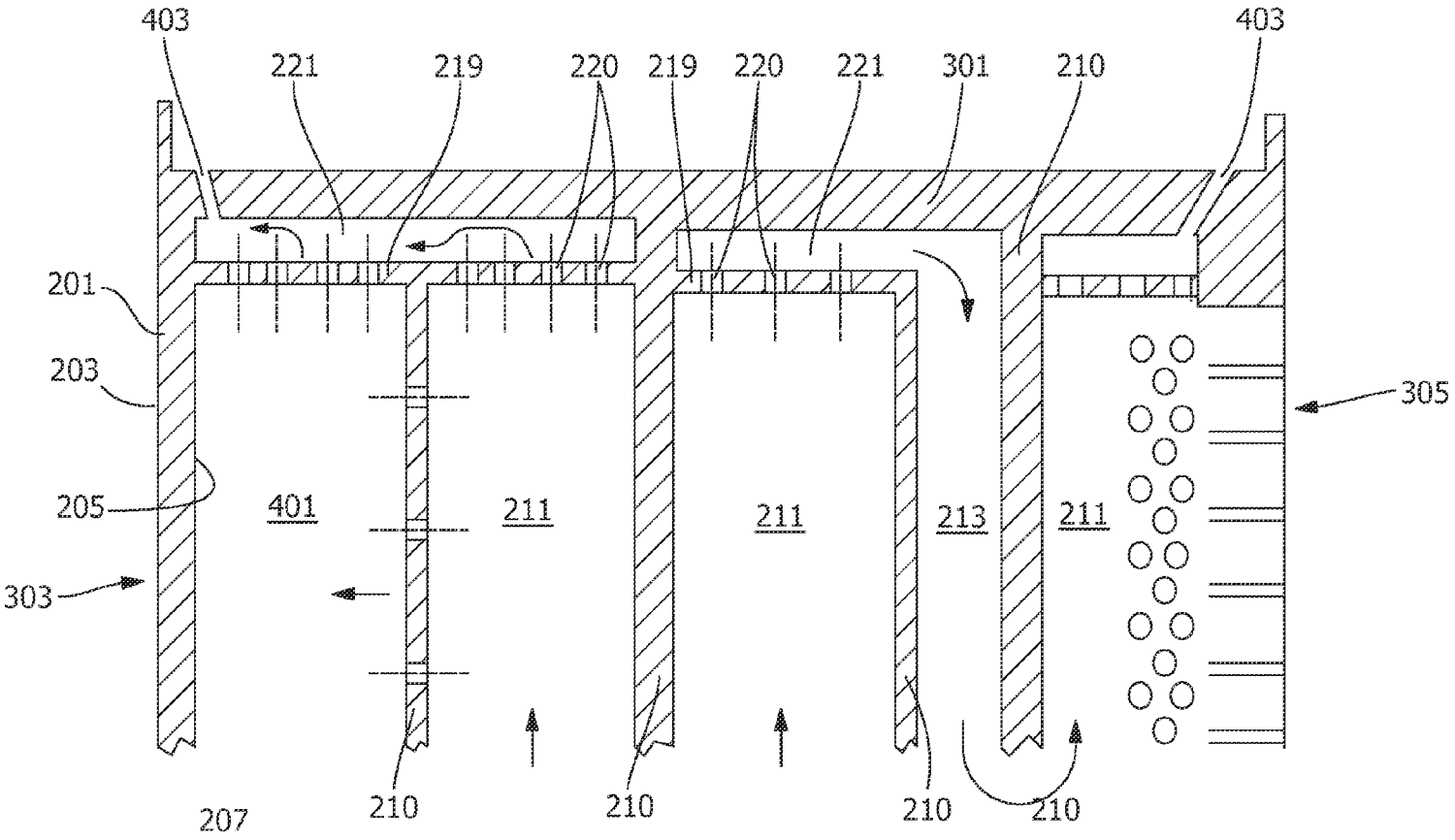
FIG. 5 is a section view of a cooling arrangement within an article, viewed orthogonal to the section view of FIG. 4.
Figure 6:
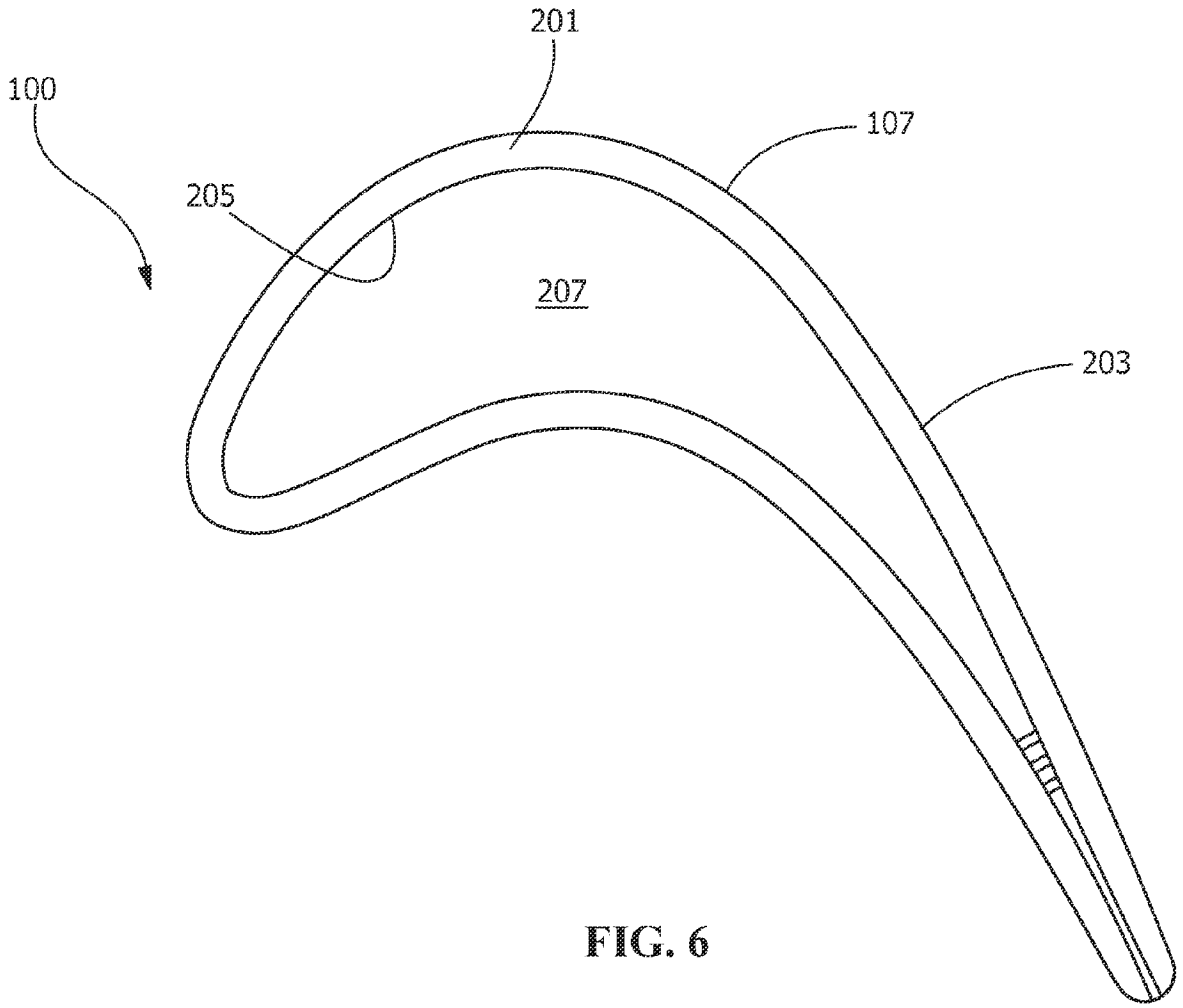
FIG. 6 shows the section view of the article of FIG. 1, taken along the line 2-2, with the partitions removed.

Turning to FIGS. 4-5, in one embodiment, the partitions 210 are positioned to form a re-use cooling arrangement within the article 100. The re-use cooling arrangement includes at least one of the up-pass cavities 211 and at least one re-use cavity 401. In another embodiment, at least one of the up-pass cavities 211 and/or at least one of the re-use cavities 401 includes the cap 219 formed therein. In a further embodiment, each of the up-pass cavities 211 and each of the re-use cavities 401 includes the cap 219 formed there. Additionally or alternatively, when each of the up-pass cavities 211 and each of the re-use cavities 401 includes one of the caps 219 formed therein, the tip cavity 221 is a continuous cavity extending over the up-pass cavity 211 and/or at least one re-use cavity 401.

The fluid entering the article 100 is provided to at least one of the up-pass cavities 211, where the fluid is directed through and/or at least partially fills the up-pass cavity 211. Once within the up-pass cavity 211, the fluid is directed through the at least one aperture 220 in the cap 219 and towards the tip portion 301. After passing through the at least one aperture 220 in the cap 219, the fluid contacts the tip portion 301, providing impingement cooling thereof. The post-impingement fluid is then directed through the tip cavity 221 and/or vented from the article 100 through a hole 403 in the body portion 201 (see FIG. 4) and/or the tip portion 301 (see FIG. 5).

Additionally or alternatively, one or more of the partitions 210 may include at least one of the apertures 220 formed therein, the aperture(s) 220 fluidly connecting the up-pass cavity 211 to the re-use cavity 401 and/or one of the re-use cavities 401 to another re-use cavity 401 downstream thereof. The fluid is directed through the aperture(s) 220 in the partitions 210 and towards the inner surface 205 of the body portion 201 in the re-use cavity 401 downstream thereof. For example, the fluid within the up-pass cavity 211 is directed through the aperture(s) 220 in the partition 210 thereof, the fluid passing through the aperture(s) 220 and towards the inner surface 205 of the body portion 201 within the re-use cavity 401 adjacent the partition 210 of the up-pass cavity 211. After passing through the aperture(s) 220 in the partition 210, the fluid contacts the inner surface 205 of the body portion 201, providing impingement cooling thereof. The post-impingement fluid from the inner surface 205 is then directed through and/or at least partially fills the re-use cavity 401 before passing through the aperture(s) in the cap 219 and/or the partition 210 thereof. In certain embodiments, the fluid within each re-use cavity 401 consists entirely or essentially of post-impingement fluid received therein. Although shown with a single re-use cavity in FIG. 5, as will be appreciated by those skilled in the art, the article 100 is not so limited and may include any suitable number of re-use cavities 401 configured to sequentially receive the fluid passing through the re-use cooling arrangement.

Any suitable number of re-use cooling arrangements may be formed within the article 100, with each re-use cooling arrangement providing fluid flow in the same, substantially the same, or a different direction as compared to the other re-use cooling arrangement(s). For example, a single re-use cooling arrangement may extend from the leading edge 303 towards the trailing edge 305, providing fluid flow in the same direction. In another example, two re-use cooling arrangements are formed in the article 100, one of the re-use cooling arrangements extending and providing fluid flow towards the leading edge 303 and the other re-use cooling arrangement extending and providing fluid flow towards the trailing edge 305. Additionally or alternatively, the article 100 may include a combination of re-use cooling arrangements and serpentine cooling arrangements.

As compared to re-use cooling arrangements without the cap 219 and/or serpentine cooling arrangements without the cap 219, which include conventional tip turn flow (i.e. down-turn flow), the impingement cooling of the tip portion 301 increases tip cooling effectiveness, increases tip cooling efficiency, increases tip cooling consistency, increases tip cooling predictability, or a combination thereof. In addition, the cap 219 provides increased control over fluid pressure in the up-pass cavity 211, the down-pass cavity 213, the re-use cavity 401, and/or the tip cavity 221; increases impingement pressure ratio; increases pressure side bleed film hole blowing ratio; decreases low velocity regions; facilitates varying a coolant side heat transfer coefficient; promotes body portion 201 and/or tip portion 301 temperatures that reduce thermal stresses and/or increase low-cycle fatigue (LCF) life; or a combination thereof. For example, in one embodiment, the cap 219 is formed in the last up-pass cavity 211 and/or the re-use cavity of a cooling arrangement, the cap 219 increasing fluid flow to the tip portion 301, which decreases or eliminates oxidation in the tip portion 301 as compared to arrangements with the cap 219. In another example, the increased control over fluid flow and fluid pressure decreases fluctuations in wall temperatures, which increases component life and/or engine performance.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An article, comprising:

a body portion having an inner surface and an outer surface, the inner surface defining an inner region;

at least one up-pass cavity formed within the inner region, the at least one up-pass cavity extending from a base of the body portion towards a tip of the body portion; and a cap formed in each up-pass cavity, each cap being adjacent to the tip of the body portion and having at least one aperture formed therein, wherein each cap is arranged and disposed to direct fluid from the at least one up-pass cavity, through the at least one aperture formed therein, and towards the tip of the body portion;

at least one down-pass cavity formed within the inner region, the at least one down-pass cavity extending from a base of the tip of the body portion towards the base of the body portion and being arranged and disposed to be downstream of the respective at least one up-pass cavity; and a respective partition disposed and positioned between each respective at least one up-pass cavity and each respective at least one down-pass cavity, each respective partition extending to the cap and being arranged such that a first face of each respective partition forms an inner wall of the respective at least one up-pass cavity and a second face opposite the first face forms an inner wall of the respective at least one down-pass cavity, wherein each respective at least one up-pass cavity terminates at the cap.

2. The article of claim 1, wherein the at least one aperture in each cap is arranged and disposed to provide impingement cooling of the tip.

3. The article of claim 1, further comprising a tip cavity formed between each cap and the tip of the body portion.

4. The article of claim 3, wherein the at least one down-pass cavity is fluidly connected to the tip cavity, the at least one down-pass cavity being arranged and disposed to direct fluid from the tip cavity towards the base of the body portion.

5. The article of claim 4, further comprising an additional up-pass cavity arranged and disposed to receive the fluid from the at least one down-pass cavity, and direct the fluid from the at least one down-pass cavity towards the tip of the body portion.

6. The article of claim 3, further comprising at least one re-use cavity formed downstream of the at least one up-pass cavity, wherein the at least one re-use cavity is separate from the down-pass cavity.

7. The article of claim 6, wherein each re-use cavity is fluidly connected to an upstream cavity, the upstream cavity being selected from the group consisting of the at least one up-pass cavity and another re-use cavity formed between the re-use cavity and the up-pass cavity, wherein an additional partition is positioned between the upstream cavity and each re-use cavity.

8. The article of claim 6, further comprising an additional cap formed in each re-use cavity, each additional cap having at least one aperture formed therein and being arranged and disposed to direct fluid from the re-use cavity, through the at least one aperture formed therein, and towards the tip of the body portion.

9. The article of claim 8, wherein each additional cap forms an additional tip cavity between the additional cap and the tip of the body portion.

10. The article of claim 9, wherein each additional tip cavity extends the tip cavity formed between the cap and the tip of the body portion towards an edge of the article.

11. The article of claim 1, wherein the cap is integrally formed with the body portion.

12. The article of claim 1, wherein the at least one aperture in the cap facilitates controlled cooling of the tip.

13. The article of claim 1, wherein the cap provides increased control over fluid pressure as compared to an uncapped up-pass cavity.

14. The article of claim 1, wherein the article is a turbine bucket.

15. The article of claim 14, wherein the cap provides impingement cooling of the tip in a trailing edge of the turbine bucket.

16. An article, comprising:

a body portion having an inner surface and an outer surface, the inner surface defining an inner region;

at least one up-pass cavity formed within the inner region, the at least one up-pass cavity extending from a base of the body portion towards a tip of the body portion;

at least one down-pass cavity fluidly connecting two cavities of the at least one up-pass cavity, each down-pass cavity being arranged and disposed to be downstream from one of the two up-pass cavities; and a cap formed in each up-pass cavity, each cap being adjacent to the tip of the body portion and having at least one aperture formed therein;

wherein each cap is arranged and disposed to direct fluid from the at least one up-pass cavity, through the at least one aperture formed therein, and towards the tip of the body portion;

wherein each aperture in the cap is arranged and disposed to provide impingement cooling of the tip; and a respective partition disposed and positioned between each respective at least one up-pass cavity and each respective at least one down-pass cavity, each respective partition extending to the cap and being arranged such that a first face of each respective partition forms an inner wall of the respective at least one up-pass cavity and a second face opposite the first face forms an inner wall of the respective at least one down-pass cavity, wherein each respective at least one up-pass cavity terminates at the cap, and wherein each respective partition is a continuous wall uniformly extending to the tip.

17. A method of cooling an article, comprising:

directing a fluid directly into a first up-pass cavity formed within an inner region of the article;

passing the fluid through at least one aperture in a cap formed in the first up-pass cavity;

contacting a tip of the article with the fluid passing through the at least one aperture in the cap, the contacting of the tip with the fluid cooling the tip and forming a post-impingement fluid;

receiving the post-impingement fluid within a down-pass cavity;

directing the post-impingement fluid through the down-pass cavity and into a second up-pass cavity;

passing the fluid from the second up-pass cavity through at least one aperture in an additional cap formed in the second up-pass cavity; and contacting the tip of the article with the fluid passing through the at least one aperture in the additional cap, the contacting of the tip with the fluid cooling the tip and forming a second post-impingement fluid, wherein the article comprises a respective partition disposed and positioned between each respective up-pass cavity and the respective down-pass cavity, each respective partition extending to the cap and being arranged such that a first face of each respective partition forms an inner wall of each respective up-pass cavity and a second face opposite the first face forms an inner wall of each respective down-pass cavity, and wherein each respective partition is a continuous wall uniformly extending to the tip.

18. The method of claim 17, further comprising cooling a side wall of the article with the fluid flowing through the first up-pass cavity, the down-pass cavity, and the second up-pass cavity.

* * * * *